United States Patent [19]

Schiavi

[11] Patent Number: 4,989,514

[45] Date of Patent: Feb. 5, 1991

[54] TROLLEY CARRYING PLURAL SETS OF PRINT CYLINDER ASSEMBLIES WITH INDEPENDENT DRIVES

[75] Inventor: Vito Schiavi, Piacenza, Italy

[73] Assignee: Schiavi Cesare Costruzioni Meccaniche S.p.A., Milan, Italy

[21] Appl. No.: 408,137

[22] Filed: Sep. 15, 1989

[30] Foreign Application Priority Data

Nov. 25, 1988 [IT] Italy ..... 40173 A/88

[51] Int. Cl.[5] ..... B41F 5/00

[52] U.S. Cl. ..... 101/216; 101/DIG. 35

[58] Field of Search ..... 101/212, 216, 219, 152, 101/153, 157, 248, DIG. 35; 414/401

[56] References Cited

U.S. PATENT DOCUMENTS

| | | | |
|---|---|---|---|
| 2,925,037 | 2/1960 | Fischer | 101/216 |
| 3,094,066 | 6/1963 | Kendrick | 101/216 |
| 3,625,145 | 12/1971 | Heatley, Jr. et al. | 101/212 |
| 3,783,782 | 1/1974 | Hardt | 101/216 |
| 3,789,757 | 2/1974 | Motter et al. | 101/153 |
| 3,876,087 | 4/1975 | Osta | 101/216 |
| 4,046,070 | 9/1977 | Halley | 101/216 |
| 4,199,289 | 4/1980 | Segbert et al. | 101/212 |
| 4,449,450 | 5/1984 | Barny et al. | 101/216 |
| 4,502,384 | 3/1985 | Habluetzel | 101/153 |

*Primary Examiner*—Eugene H. Eickholt

*Attorney, Agent, or Firm*—Hoffmann & Baron

[57] ABSTRACT

The trolley comprises a movable frame (2) carrying two separate print assemblies comprising cylinder (5-5*a*), doctor (6-6*a*) and ink rail (7-7*a*), and is capable of traversing horizontally at right angles to the print station of a rotary machine; the frame can be locked into two distinct positions, each of which has one of the two print assemblies correctly aligned with the impression cylinder and the rotary drive shaft, while the other stands off the machine and is freely accessible for servicing purposes. The trolley also has its own on-board drive system capable of setting the cylinder of the spare print assembly in rotation on the frame, independently of the other cylinder, which continues occupying and operating in the print station, so that adjustments can be made in readiness for the next run without stopping the machine.

2 Claims, 1 Drawing Sheet

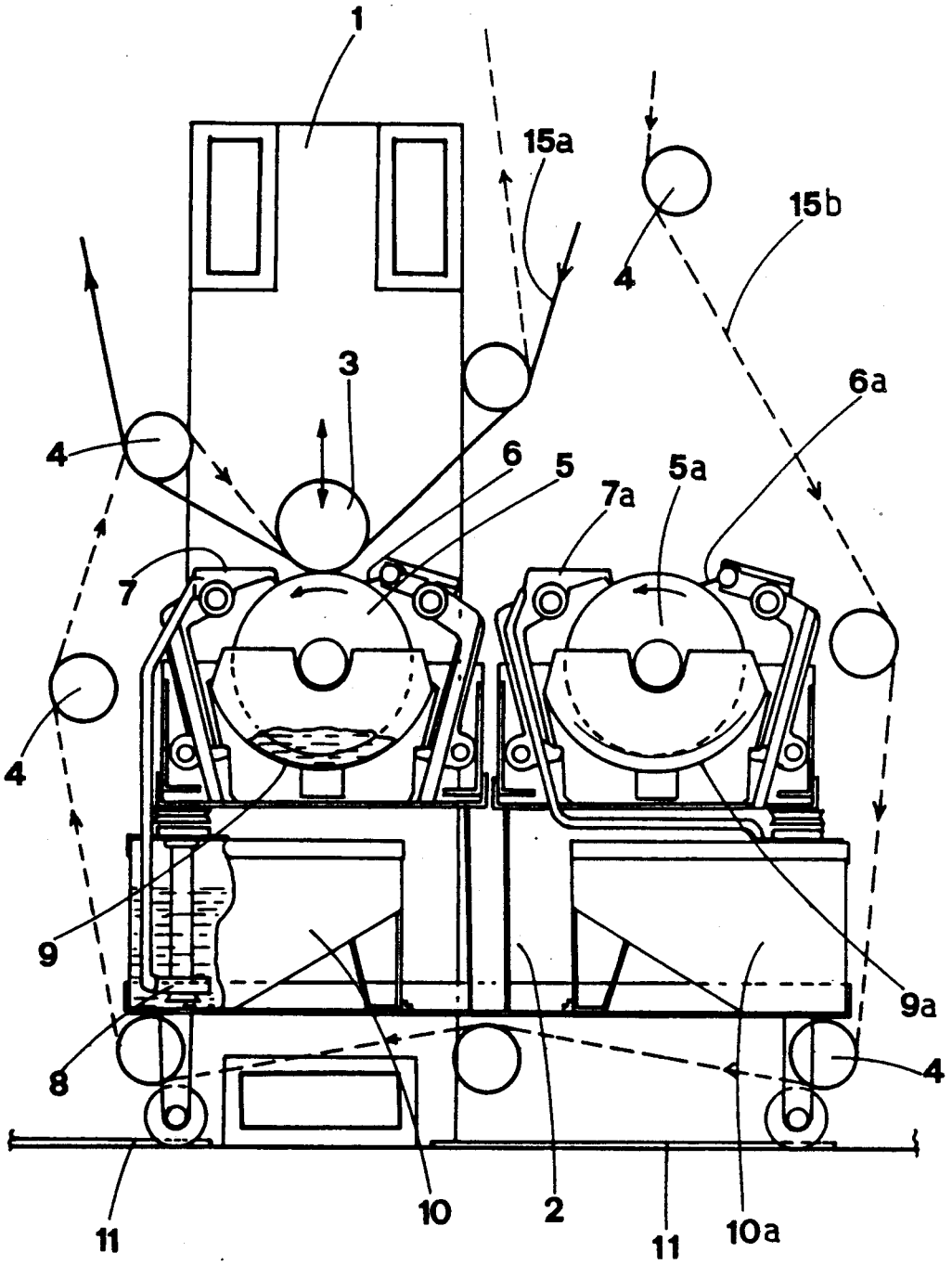
1
15a
15b
4
3
6a
4
6
5
5a
7a
7
4
9
9a
8
4
11
10
2
11
10a

TROLLEY CARRYING PLURAL SETS OF PRINT CYLINDER ASSEMBLIES WITH INDEPENDENT DRIVES

BACKGROUND of the INVENTION

The present invention relates to a trolley for the support of print cylinder assemblies as used in the stations of rotary printing machines.

Rotary machines used to implement both rotogravure and flexographic processes incorporate a number of print stations, each of which producing a single color. Each station comprises a revolving print cylinder bearing an image to be reproduced, against which a web of material is urged by an impression cylinder in such a way as to receive the image. The single station also comprises an arrangement for supplying ink to the cylinder, whether through a pumped system or by simple immersion, and a blade (the 'doctor'), by which superfluous ink is wiped from the cylinder.

Each such assembly comprising print cylinder, ink supply system and doctor is provided further with accessories, such as devices designed for correct positioning and adjustment of the ink rail, doctor blade, ink vessels, etc...

In operation, the web is fed between the print and impression cylinders of each successive station, receiving one color component of the composite image at each station as it proceeds.

With each printing run completed, preparation for another (with a different image) clearlY involves changing over all print cylinders at the various stations.

Such a procedure is notably time-consuming, as the print cylinder must be lifted from its bearings and replaced by the cylinder needed for the next run; in addition, new inks must be put into the relative systems, all parts in contact with the ink having been thoroughly cleaned and flushed, whereupon the cylinder must be correctly positioned in relation to the station, and the doctor in relation to the cylinder. Needless to say, the changeover procedure must be carried through for each single station. Furthermore, the general problems thus outlined are aggravated further by the fact that print cylinders are typically heavy and cumbersome.

With changeover in progress, the machine clearly must remain at a standstill of duration dependent upon the number of individual stations; in effect, the interruption is never less than two or three hours, and given the high purchase price of rotary printing equipment, every stoppage represents an increase in overheads which, in practice, denies cost-effective operation in the case of small runs; at all events, down time will constitute a part of the costs in any contract undertaken, and persons skilled in the art know full well that where rotary printing equipment is involved, such costs run into hundreds of dollars per hour.

For some time now, the operation of changing over print cylinders has been speeded up by the use of trolleys. Each cylinder is carried by a relative trolley that can be positioned beneath the print equipment installed at each station, in such a way as to facilitate fitment and removal of cylinders generally, into and from corresponding stations. The standard practice is to utilize two trolleys per print station; thus, while one trolley remains with the machine, in readiness for removal of the cylinder, and if necessary, the ink supply, the spare trolley can be equipped with a new cylinder and ink supply in readiness to replace the trolley removed.

With the replacement trolley brought into the machine, it then remains to position the cylinder correctly in relation to the station and make the connection to the drive system by which it is set in rotation, and then effect all adjustments, e.g. to the ink supply system and the doctor, such as are required to ensure faultless printing.

Even with this method, the time needed to effect a changeover between jobs will never be less than two or three hours, especially where the machinery incorporates a significant number of stations. A further drawback encountered with this changeover method stems from the need to move spare trolleys around internally of the print room; even carrying a print cylinder alone, the type of trolley in question is notably heavy and difficult to handle. Accordingly, the object of the present invention is to overcome the drawbacks described above through the adoption of a trolley that ensures a drastic reduction in down time between production runs, and presents no great handling problems.

SUMMARY OF THE INVENTION

The stated object, and other objects besides, are realized with a trolley according to the present invention, which comprises a movable frame carrying two distinct print cylinder, doctor and ink supply assemblies; such a trolley is capable of horizontal movement in a direction transverse to the structure of the print station and can be made fast in two distinct positions, each one of which brings one of the cylinder assemblies into correct alignment with the station, leaving the remaining assembly away from the station and freely accessible. The trolley disclosed further comprises drive means by which the print cylinder of either assembly can be set in rotation on the trolley, independently of the other cylinder, so as to enable preparation of the assembly currently outside the station while the assembly occupying the station continues to print.

BRIEF DESCRIPTION of the DRAWINGS

The invention will now be described in detail, by way of example, with the aid of the accompanying drawing, which is a schematic representation of the trolley viewed in side elevation with certain parts cut away and certain parts omitted better to reveal others.

DESCRIPTION of the PREFERRED EMBODIMENTS

Rotary printing machines generally will comprise a plurality of print stations, each one of which producing one color of the set utilized for the composite image. In the drawing, 1 schematically denotes the fixed gantry type structure of such a station.

It will be observed, that whilst the drawing and the specification illustrate and refer to a print station operating with rotogravure equipment, the invention is equally applicable, mutatis mutandis, to stations operating with flexographic equipment, which differs mechanically from the rotogravure type in having a number of print cylinders, rather than just the one.

3 schematically denotes an impression cylinder suspended from the structure 1, which is capable of movement through a vertical path and serves, during print, to urge the running web of material against the inked cylinder offered by an assembly beneath.

As regards the web itself, 15*a* and 15*b* denote the respective paths followed through a set of guide rolls 4 when printing face and reverse, of which more will be said in due course.

A trolley according to the invention comprises a movable frame 2 capable of horizontal movement in a transverse direction (as viewed in the drawing), with respect to the fixed structure 1; whilst the drawing illustrates a manually propelled trolley frame mounted on wheels and running on tracks 11, the option clearly exists of adopting a different arrangement, for example power driven and rolling on racks, rails etc.

The frame 2 carries two distinct rotary assemblies side by side, each of which comprising one print cylinder 5—5*a*, a doctor 6—6*a*, an ink rail 7—7*a*, and an ink bath 9—9*a*; in addition, the ink fountain system for each assembly comprises a tank 10—10*a*, and a pumping circuit 8 (the circuit 8*a* of the right hand assembly is not visible in the drawing). The entire assembly of components thus described is conventional in embodiment, as indeed will be the various adjustment mechanisms and control devices normally associated with rotary printing equipment; accordingly, no further description is necessary.

Also, it will be appreciated that such an assembly might operate without the ink rail 7—7*a*, and pick up ink from the bath 9—9*a* by simple immersion. The trolley carries first locating means designed to interact with second locating means offered by the structure of the print station, which permit of making the trolley fast, relative to the structure, in two distinct positions; more exactly, in each such position, one of the two assemblies will lie in correct alignment with the impression cylinder, and with first drive means which form a part of the station and serve to set the print cylinder in rotation, whilst the remaining print assembly remains outside the station and readily accessible. As in any conventional machine, the first drive means will take the form of a power take-off shaft; moreover, the drive system will be such that the single print cylinders of the several stations can be operated together and synchronized.

Neither the first nor the second locating means are illustrated in the drawing, being conventional in embodiment and of any given type.

The trolley also carries second drive means, also of conventional embodiment and therefore not shown in the drawing, which permit of rotating the print cylinders of the two assemblies on the trolley, one independently of the other; such second drive means will be provided with a reversing device, which is conventional likewise and therefore omitted.

Operation of the trolley will now be described. In the situation shown in the drawing, the left hand assembly is engaged in printing the face of the web (route 15*a*), while the right hand assembly lies outside the area of the station and remains accessible to the operator.

Accordingly, the operator is able to replace the cylinder of the right hand assembly, clean the ink rail and feed circuit, and if necessary, replenish with ink of a different type and/or color. This accomplished, the second drive means are operated so as to set the cylinder 5*a* in rotation and thus permit of running a test in conditions practically identical to those of final operation (excepting the speed of rotation, which will be much higher when in print), so as to adjust the doctor setting and ink supply. Having completed these steps, the operator will keep the cylinder 5*a* revolving so as to prevent ink from drying on the surface (which would occur if the cylinder were left standing, as the inks used for the processes in question are quick-drying), and creating serious difficulties subsequently when in print.

Once the left hand assembly has finished its run, the impression cylinder 3 will be raised, the print cylinder 5 disconnected from the first drive means (machine), and the trolley then traversed right to left (as seen in the drawing) in such a way as to bring the replacement cylinder 5*a* into the printing position.

The second drive means (trolley) are now stopped and disconnected, and the replacement cylinder 5*a* coupled to the first drive means (machine). This done, the impression cylinder 3 is lowered and printing can recommence immediately by virtue of the fact that the cylinder 5*a* of the replacement assembly is ready to operate, having been set up and adjusted previously; all that remains, in fact, is to position the cylinder by moving the trolley from one side of the machine to the other.

Once the replacement cylinder 5*a* is in operation, the preparatory work described above can commence on the cylinder 5 of the assembly just removed, as this now stands clear of the print station and accessible on the left hand side of the machine. It will be clear enough that the rotary machine need remain idle during changeover for no more than a few minutes, i.e. far shorter than the down times registering typically hitherto.

The speed of the changeover between one run and the next is attributable essentially to the fact that the replacement print cylinder is already mounted in its bearings, carried by the movable frame, and needs simply to be connected to the shaft of the first drive means, whereupon all cylinders of the various stations are set in synchronized rotation; moreover, the cylinder not currently utilized in production can be subjected to simulated production conditions by operation of the second drive means, so that all necessary running adjustments can be made before the assembly is traversed into the print station.

As an alternative option to the procedure described in the foregoing, cleaning and ink replenishment operations might also be accomplished by stripping down the relative parts of the movable frame and transferring them to workshops suitably equipped for the purpose; however, final adjustments will still be made with these parts fully assembled on the trolley, and the cylinder revolving.

Similarly, the option exists of abandoning the idea of a single trolley carrying the two assemblies in favor of two separate trolleys, each one of which possessing the essential features of the trolley as described above; whilst such an expedient might bring a certain advantage in that preparation of the replacement print cylinder assembly could be undertaken remotely from the rotary machine, hence in better appointed surroundings, there is still the notable disadvantage of having to displace a trolley with the entire print cylinder assembly fitted.

When backing-up the reverse side of the web (see route 15*b*, illustrated in phantom line), the print cylinder must be rotated in the opposite direction, and the positions of the doctor and the ink rail inverted (lying respectively left and right of the cylinder as seen in the drawing). In this instance, the cylinder needs to be rotated in the opposite direction during set-up operations (a facility made available by incorporation of the aforementioned reversing device). Regarding the changed positions of the doctor and ink rail, it suffices simply to offer the trolley to the print station the opposite way around to that shown in the drawing; in the event that the trolley frame is embodied in such a way that it cannot be separated from the print station, then it will be necessary to ensure that the doctor and ink rail are made detachable, and that each can be refitted on either side of the print cylinder with equal ease.

What is claimed is:

1. A trolley for print cylinder assemblies as used in a rotary machine including a print station having a gantry type structure, comprising:

a movable frame (2) carrying two distinct print assemblies disposed side by side, each affording a print cylinder (5—5*a*), a doctor (6—6*a*) and devices (7—7*a*) supplying ink to the cylinder, and capable of horizontal motion in a direction transverse to the gantry type structure (1) of the print station equipped with an impression cylinder (3) adapted to urge a web of printable material against the print cylinder (5, 5*a*) bearing the image to be transferred, and with first drive means serving to set the print cylinder in rotation;

means for horizontally moving the frame in a direction transverse to the gantry type structure of the print station;

first location means, designed to interact with second locating means offered by the structure (1) of the station, and to permit of making the trolley fast in relation to the station at either of two distinct positions whereby one of the two print assemblies is correctly aligned with the impression cylinder and the first drive means, ready to print, and the remaining assembly positioned outside the area of the print station and freely accessible for service purposes; and second drive means that permit of setting the cylinders of the two print assemblies in rotation on the trolley, one independently of the other.

2. A trolley as in claim 1, wherein the second drive means are provided with a reversing device of conventional embodiment.

* * * * *